United States Patent [19]

Nakamura et al.

[11] Patent Number: 4,506,423

[45] Date of Patent: Mar. 26, 1985

[54] METHOD OF PRODUCING A FLUID PRESSURE REDUCING DEVICE

[75] Inventors: Keiichi Nakamura, Ebina; Hiroshi Asao, Fujisawa; Kenichi Okada, Yokohama; Yoichi Wakabayashi, Sano; Izumi Ochiai, Tochigi, all of Japan

[73] Assignee: Hitachi, Ltd., Tokyo, Japan

[21] Appl. No.: 512,948

[22] Filed: Jul. 13, 1983

Related U.S. Application Data

[62] Division of Ser. No. 333,415, Dec. 22, 1981, abandoned.

[30] Foreign Application Priority Data

| | | | |
|---|---|---|---|
| Dec. 24, 1980 | [JP] | Japan | 55-182084 |
| Dec. 24, 1980 | [JP] | Japan | 55-182085 |
| Jun. 26, 1981 | [JP] | Japan | 56-93724 |

[51] Int. Cl.[3] ..... B21D 53/00; B21K 29/00; B23P 15/26

[52] U.S. Cl. ..... 29/157 R; 29/157 C; 29/157.1 R; 29/421 R; 29/421 M; 62/511; 62/527; 138/42; 138/149; 251/126

[58] Field of Search ..... 29/517, 157 R, 516, 29/157.3 B, 157 C, 456, 157.1 R, 421 R, 157.3 AH, 421 M; 62/511, 527; 138/40–43, 149, DIG. 4; 251/126, 121

[56] References Cited

U.S. PATENT DOCUMENTS

| | | | |
|---|---|---|---|
| 856,316 | 6/1907 | Thurston | 29/517 UX |
| 1,179,853 | 4/1916 | McCulloch | 29/516 UX |
| 1,506,722 | 8/1924 | Yunker | 29/157 C |
| 1,813,979 | 7/1931 | West | 62/511 X |
| 1,957,829 | 5/1934 | Greenwald | 138/41 |
| 1,975,634 | 10/1934 | Dijksterhuis | 138/42 X |
| 2,026,774 | 1/1936 | Davis et al. | 29/517 UX |
| 2,289,905 | 7/1942 | Dasher | 62/527 |
| 2,312,834 | 3/1943 | Hahn | 138/43 |
| 2,323,115 | 6/1943 | Bryant | 138/43 |
| 2,588,555 | 3/1954 | Molloy | 251/126 X |
| 2,683,973 | 7/1954 | Mettler | 138/41 X |
| 3,245,139 | 4/1966 | Scolaro | 29/455 R X |
| 3,425,719 | 2/1969 | Burton | 29/516 X |
| 3,551,999 | 1/1971 | Gutmann | 29/517 |
| 3,552,445 | 1/1971 | Andrews | 138/149 X |
| 3,716,902 | 2/1973 | Pearce | 29/157 C |
| 3,735,475 | 5/1973 | Marriott | 29/455 R |
| 3,777,343 | 12/1973 | D'Onofrio | 29/157.3 AH X |
| 3,785,163 | 1/1974 | Wagner | 62/511 X |
| 3,840,209 | 10/1974 | James | 138/43 X |
| 3,916,504 | 11/1975 | Thorne et al. | 29/456 X |
| 4,106,525 | 8/1978 | Currie et al. | 138/43 |
| 4,190,131 | 2/1980 | Robinson | 138/149 X |

FOREIGN PATENT DOCUMENTS

| | | | |
|---|---|---|---|
| 354476 | 8/1931 | United Kingdom | 138/40 |

*Primary Examiner*—Charlie T. Moon

*Attorney, Agent, or Firm*—Antonelli, Terry & Wands

[57] ABSTRACT

A fluid pressure reducing device having a core provided with a peripheral spiral groove and a pipe receiving the core. The portion of the pipe receiving the core is radially contracted so that the ridges of the spiral groove of the core intrude into the inner peripheral surface of the pipe, thereby to form a spiral passage between the pipe and the core. The pressure of a fluid is reduced as the latter flows through the spiral passage. This fluid pressure reducing device is easy to produce and permits an easy fine adjustment of the flow resistance.

15 Claims, 13 Drawing Figures

METHOD OF PRODUCING A FLUID PRESSURE REDUCING DEVICE

This application is a division of application Ser. No. 333,415, filed Dec. 22, 1981, now abandoned.

BACKGROUND OF THE INVENTION

The present invention relates to a fluid pressure reducing device having a spiral groove through which a fluid such as gas or liquid flows to reduce its pressure. The fluid pressure reducing device of the invention is suitable for use particularly as a refrigerant pressure reducing device for reducing the pressure of the liquid refrigerant compressed by a compressor in a refrigerant circuit of a refrigerator or an air conditioner.

The fluid pressure reducing device used hitherto has a form of a thin-walled copper tube of small diameter generally referred to as "capillary tube" wound in a loop-like form for an easier mounting in the refrigerator or the like apparatus. In producing this conventional fluid pressure reducing device, it is necessary to loop the tube at a large radius of curvature, for otherwise the cross-section of the tube may be distorted to adversely affect the pressure reducing performance. Consequently, the pressure reducing device occupies an uneconomically large space. In addition, the looped tube is quite unstable and has a small resistance to any external force, so that the tube has to be handled with great care to avoid any distortion or breakage.

In order to eliminate these disadvantages of the looped tube type pressure reducing device, in recent years, a fluid pressure reducing device has been proposed, with a cylindrical core having a peripheral spiral groove being fitted or screwed in a pipe. In this type of fluid pressure reducing device, the pressure of the fluid is reduced as the latter flows through a spiral passage defined between the peripheral spiral groove of the core and the inner surface of the pipe. This type of fluid pressure reducing device has a compact construction and exhibits a considerably high resistance to the external damaging force.

This type of fluid pressure reducing device, however, has the following disadvantage. Namely, for a smooth and tight fit of the core into the pipe, it is essential that the outer peripheral surface of the core and the inner peripheral surface of the pipe have to be finished at a high dimensional precision, so that the cost of production is uneconomical. In the case where the core is pressed and fitted into the pipe, it is extremely difficult to finely adjust the flow resistance in the pressure reducing device because, in this case, the fine adjustment of the size of the spiral passage can hardly be effected. Thus, in this case, it is difficult to produce a device having a desired flow resistance and this results in a low production yield. In contrast, in the case where the core is screwed into the pipe, it is comparatively easy to make a fine adjustment of the flow resistance, because the depth or length of screwing of the core into the pipe can be varied and adjusted at a high precision to permit a fine adjustment of the size of the spiral passage. In this case, however, it is necessary to use pipes having comparatively large wall thicknesses, because of the necessity for forming a mating screw thread in the inner peripheral surface of the pipe. The formation of the screw thread in the pipe increases the number of steps of the production process thereby resulting in an increase in the production cost.

It is possible to drive the core having a spiral groove directly into the wall of the pipe having no screw thread. This method, however, cannot be applied to thin-walled pipes because of a large possibility of rupture or cracking in the pipe. In addition, there are problems concerning the disposal of the metal chips produced as a result of the driving of the core. It is also to be pointed out that the driving of the core requires a much labor and time.

Thus, the known fluid pressure reducing device composed of a core with a spiral groove and a pipe receiving the core cannot be produced at a moderate cost because of the necessity for the high dimensional precision of the core and pipe, increased number of steps of production due to the fitting or screwing of the core into the pipe and so forth. In addition, the fine adjustment of the flow resistance is difficult to perform particularly in the case where the core is merely inserted and fitted in the pipe.

SUMMARY OF THE INVENTION

Accordingly, an object of the invention is to provide a fluid pressure reducing device which can be produced easily irrespective of the dimensional precision of the constituents such as core and pipe and which permits an easy fine adjustment of the flow resistance in the course of the production.

To this end, according to the invention, there is provided a fluid pressure reducing device having a core provided with a peripheral spiral groove and a pipe in which the core is received, wherein, after the insertion of the core into the pipe, the pipe is contracted to make the ridges of the spiral groove intrude into the inner peripheral surface of the pipe to thereby form a spiral passage through which a fluid flows to reduce its pressure.

DESCRIPTION OF THE PREFERRED EMBODIMENTS

The invention will be fully understood from the following description of the preferred embodiments taken in conjunction with the attached drawings.

Figure 1:
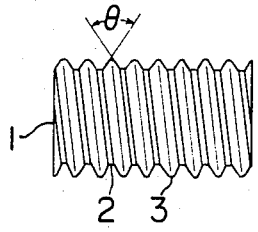
FIG. 1 is a side elevational view of a first example of a core incorporated in the fluid pressure reducing device of the invention.
Figure 2:
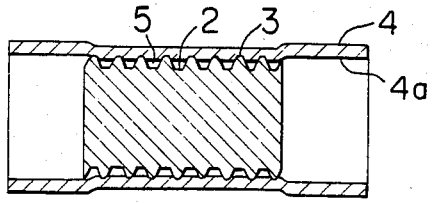
FIG. 2 is a sectional view of a fluid pressure reducing device constructed in accordance with a first embodiment of the invention.

Referring now to the drawings wherein like reference numerals are used throughout the various views to designate like parts and, more particularly, to FIGS. 1 and 2, according to these figures, a core 1 is formed as a cylindrical member made of a steel and provided with a spiral groove 2 formed in the outer peripheral surface thereof. The ridges 3 of the spiral groove 2 have a triangular cross-sectional shape with an apex angle $\theta$. Although the spiral groove 2 is illustrated to have a V-shaped cross-section in FIG. 1, this cross-sectional shape is not exclusive and the spiral groove 2 can have other cross-sectional shape such as U-like shape. The apex angle $\theta$ of the ridges 3 of the spiral groove 2 can be selected to be in the range of between 20° and 120°. From a view point of easiness of the mechanical processing of the ridges 3, however, the apex angle $\theta$ is preferably selected to be 60°. The use of a steel as the material of the core 1 is preferred for various reasons such as low price, superior resistance to corrosion by the fluid such as freon, large resistance to deformation than the pipe material which is usually copper to ensure a smooth intrusion into the pipe wall, and so forth. The use of steel, however, is not exclusive and the core may be made from brass, duralumin or the like, provided that the circumstance allows the use of such materials.

The spiral groove 2 of the core 1 of FIGS. 1 and 2 is formed by cutting. The spiral groove 2, however, may be formed by other method such as casting, rolling or the like. In general, it is difficult to obtain an acute apex angle of the ridges 3 when the groove 2 is formed by casting or rolling. It is, however, not essential that the ridges 3 have an acute apex angle. Namely, any apex angle is acceptable provided that the ridge 3 of the spiral groove can easily intrude into the inner surface of the pipe when the latter is contracted.

Although the core 1 shown in FIG. 1 has only one spiral groove 2, the core can have two or more spiral grooves 2. By forming a plurality of spiral grooves 2, it is possible to reduce the flow resistance in the pressure reducing device as compared with the case where the core has only one spiral groove 2.

After inserting the core 1 into a copper pipe 4, the portion of the pipe 4 receiving the core 1 is uniformly contracted radially so that the ends of the ridges 3 intrude into the inner peripheral surface 4*a* of the pipe 4. Consequently, a fine spiral passage 5 is formed between the core 1 and the pipe 2 to provide a communication between both sides of the pipe 4.

The fluid pressure reducing device thus constructed may be connected in the refrigerant circuit of a refrigerator or an air conditioner. In such a case, the cross-sectional area of the fluid passage 5 is drastically changed at the fluid pressure reducing device, so that the pressure of the refrigerant is reduced due to the flow resistance. Thus, the fluid pressure device of the invention can be used as the refrigerant pressure reducing device in refrigerant circuit.

When it is necessary to change the pressure reducing effect to cope with a varying demand of power and capacity of the refrigerator or air conditioner, it is possible to change the pressure reducing effect through an adjustment of the flow resistance. In the pressure reducing device of the invention, this can be achieved simply by adjusting the amount of contraction of the pipe 4 by a suitable control of the contraction pressure applied to the outer peripheral surface of the pipe 4. Namely, by varying the contraction pressure, the size of the cross-section of the spiral passage 5 is changed to cause a change in the flow resistance. For a greater change of the pressure reducing effect, it is possible to vary the factors such as the form of the spiral groove 2 and, accordingly, the form of the ridges 3, pitch of the spiral groove 2, number of turns of the spiral groove 2, length of the core 1 received by the pipe 4, and so on.

As will be understood from the foregoing description, the fluid pressure reducing device of the invention can be produced easily and at a low cost, because the high dimensional precision of the core 1 and pipe 4, necessary in the known devices, is not required thanks to the feature that the ends of the ridges 3 of the spiral groove 2 tightly intrude into the inner peripheral surface of the pipe 4 as a result of a radial contraction of the latter.

In addition, the flow resistance, i.e. the pressure reducing effect, can be adjusted easily and precisely by an adjustment of the amount of contraction of the pipe 4 during joining of the core 1 to the pipe 4.

Furthermore, since the ridges 3 of the spiral groove 2 firmly intrude into the inner peripheral surface 4*a* of the pipe 4, a constant pressure reducing performance is maintained for a long period of time.

Figure 3:
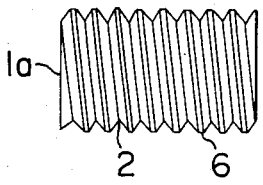
FIG. 3 is a side elevational view of a second example of the core.
Figure 4:
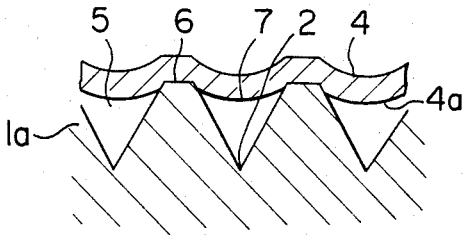
FIG. 4 is an enlarged sectional view of a pressure reducing device constructed in accordance with a second embodiment of the invention in which a pipe receiving the core shown in FIG. 3 is contracted.

A second embodiment of the present invention will be described with reference to FIGS. 3 and 4 and, according to these figures, a core 1*a* has the spiral groove 2 formed in the outer peripheral surface thereof, with ridges 6 of the spiral groove 2 having a trapezoidal cross-section. The trapezoidal cross-section of the ridges 6 offers the following advantage in addition to the advantages brought about by the first embodiment of FIGS. 1 and 2.

Namely, since the ridges 6 of the spiral groove 2 of the core have trapezoidal ends, the amount of depth of intrusion by the ridges 6 for a given pipe contracting pressure is small as compared with the first embodiment in which the ridges 3 have a comparatively keen edge. This in turn permits a more minute control of the cross-sectional area of the spiral passage 5. Thus, the embodiment of FIGS. 3 and 4 permits an easier fine adjustment of the flow resistance when the core 1*a* is joined to the inner peripheral surface 4*a* of the pipe 4.

Another advantage is as follows. Namely, since the reduction of the cross-sectional area of the annular passage 5 is caused not only by the intrusion of the ridges 6 into the inner peripheral surface 4*a* of the pipe 4 but also by the radially inward projection 7 of the pipe wall at portions between adjacent ridges 6 as shown in FIG. 4, it is possible to obtain a large reduction of the cross-sectional area of the spiral passage 5 even with a small depth of intrusion by the ridges 6 into the inner peripheral surface 4*a* of the pipe 4. This means that the cross-sectional area of the spiral passage 5 can be reduced largely without the danger of cracking of the pipe 4 even when the latter has a comparatively small thickness.

Figure 5:
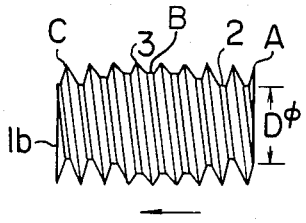
FIG. 5 is a side elevational view of a third example of the core.
Figure 6:
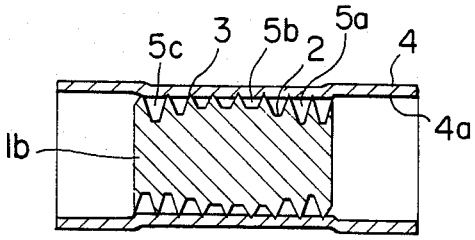
FIG. 6 is a sectional view of a fluid pressure reducing device constructed in accordance with a third embodiment of the invention.

FIGS. 5 and 6 provide an example of a third embodiment of a fluid pressure reducing device of the present invention wherein a diameter $D^{\phi}$ of a valley of the spiral groove 2 is varied along a longitudinal axis of a core 16, i.e. in the direction of the arrow in FIG. 5. More specifically, the diameter $D^{\phi}$ of the valley of the spiral groove 2 is gradually increased from an inlet section A of the core 1*b* toward a central section B where the diameter $D^{\phi}$ takes the maximum value and then decreased again toward an outlet section C. This change of the diameter $D^{\phi}$ offers the following advantage in addition to those presented by the first embodiment of FIGS. 1 and 2.

Namely, in the pipe 4 radially contracted as shown in FIG. 6 after the insertion of the core 1, the cross-sectional area of the spiral passage 5 is changed such that it is gradually decreased from an inlet portion 5*a* of the spiral passage 5 toward a central portion 5*b* and then increased again toward an outlet portion 5*c* of the spiral passage 5. Consequently, the cross-sectional area of the fluid circuit in the portion of the latter where the fluid pressure reducing device is connected can be changed progressively or gradually but not abruptly, so that it is possible to eliminate the noise which may otherwise be caused by the fluid flowing across a large reduction of cross-sectional area.

This silencing effect can be achieved also by a fourth and fifth embodiments of the invention which will be described hereinunder with reference to FIGS. 7 and 8.

Figure 7:
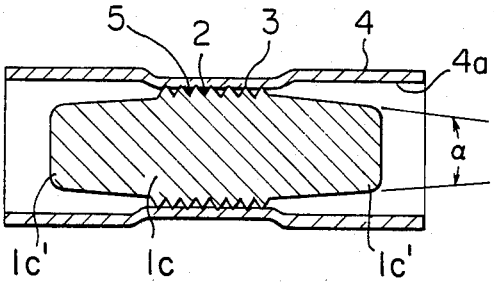
FIG. 7 is a sectional view of a fluid pressure reducing device constructed in accordance with a fourth embodiment of the invention.

Referring first to FIG. 7, the fluid pressure reducing device includes a core 1*c*, with ends shaped into a frusto-conical projections 1*c'* having a taper angle $\alpha$. The tapered frusto-conical projection 1*c'* permits a gradual change of the cross-sectional area of the fluid passage from the cross-sectional area of the pipe 4 to the cross-sectional area of the spiral passage 5 and vice versa, to further obviate the drastic change of the cross-sectional area, thereby to eliminate the noise which may, for otherwise, be caused by the fluid passing through a section where the cross-sectional area is changed drastically. The taper angle $\alpha$ is practically selected to fall within a range of between 4° to 20°. It has been confirmed that the greatest silencing effect can be obtained when the taper angle $\alpha$ is selected to be 14°.

Figure 8:
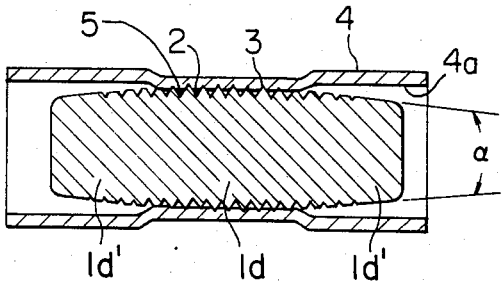
FIG. 8 is a sectional view of a fluid pressure reducing device constructed in accordance with a fifth embodiment of the invention.

Referring now to FIG. 8, a core 1*d* provided with a spiral groove 2 is cut at its both ends such that tapered frusto-conical end projections 1*d'* are formed at both ends thereof. The core 1*d* of the the embodiment of FIG. 8 can advantageously formed simply by cutting both ends of the cylindrical core provided beforehand with the spiral groove 2, at a taper angle $\alpha$. The preferred range of the taper angle $\alpha$ in relation to the silencing effect is identical to that of the of FIG. 7 embodiment.

Although it is preferable to provide frusto-conical 1*c'*, 1*d'* at both ends of the core 1*c*, 1*d*, since in the operation of this kind of fluid pressure reducing device, noise is mainly generated at the fluid outlet side of the core, the frusto-conical projection 1*c'*, 1*d'* may be provided only at the fluid outlet side of the core 1*c*, 1*d*.

Figure 9:
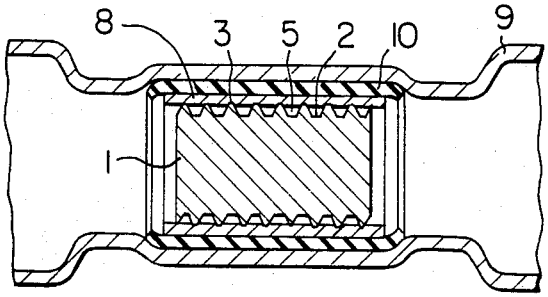
FIG. 9 is a sectional view of a fluid pressure reducing device constructed in accordance with a sixth embodiment of the invention.

A sixth embodiment of the invention will be explained hereinunder with reference to FIG. 9 which shows a fluid pressure reducing device of a double pipe structure. More particularly, as shown in FIG. 9, the double pipe structure includes an inner pipe 8 made of copper, an outer pipe 9 also made of copper and a sound absorption pipe 10 of a sound absorption material such as butyl rubber interposed between the inner and outer pipes 8, 9. This arrangement offers following advantage in addition to the advantages brought about by the embodiment of FIGS. 1 and 2.

Namely, the noise produced by the fluid flowing through a section of a large change of cross-sectional area is absorbed by the sound absorption pipe 10, so that the transmission of the noise to the outer pipe 9 is prevented. Thus, this embodiment provides a greater silencing effect.

In producing the fluid pressure reducing device of this embodiment, the contraction of the pipe can be achieved by the following manner. The detail of the pipe contracting process itself will be explained later. Namely, in the embodiment of FIG. 9, the inner pipe 8 is contracted after the insertion of the core 1. Then, the sound absorption pipe 10 and the outer pipe 9 are fitted and additional pipe contraction is effected as necessitated.

Alternatively, the double pipe structure of the inner pipe 8, outer pipe 9 and the sound absorption pipe 10 is formed beforehand, and a pipe contraction is effected after the insertion of the core 1 into the inner pipe 8. In this case, the fluid pressure reducing device of the embodiment of FIG. 9 can be formed by a single pipe contraction.

The use of butyl rubber as the sound absorbing material is not essential. Namely, it is possible to use any material having a sound absorption power and a resistance to the fluid, such as fluoride resin or other resins, silicon rubber or other rubbers, foamed metals and so forth, as the material of the sound absorption pipe 10.

It is to be understood that the embodiments described heretofore are shown only for the illustrative purpose and can be varied and modified in various forms.

For instance, the embodiments of FIGS. 3–9 can be applied with the modifications or variations explained before in connection with the first embodiment, namely, the possibility of use of materials other than steel as the core material, adoption of processing method other than cutting, such as casting, rolling or the like for the formation of the spiral groove 2, and formation of two or more spiral grooves in the core surface.

The embodiments of FIGS. 3–9 have their own advantages in addition to the advantages proposed by the embodiment of FIGS. 1 and 2. Needless to say, these embodiments can be carried out solely or in combination to attain the optimum effect to meet the demands or conditions such as the power and capacity of the refrigerator or air conditioner.

Figure 11:
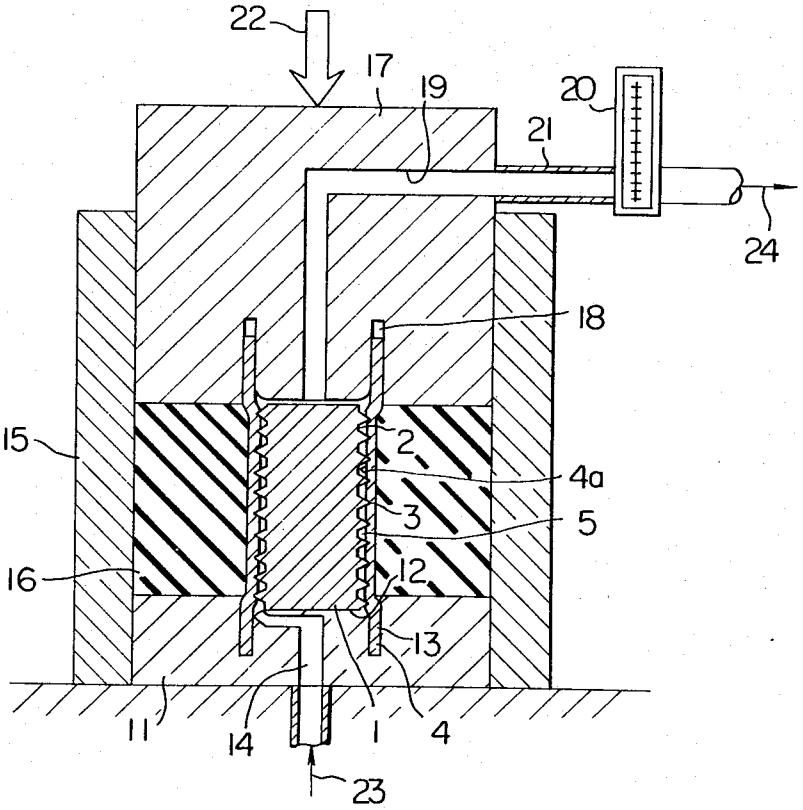
FIG. 11 is a sectional view showing the pipe contracting operation by the pipe contracting apparatus shown in FIG. 10.
Figure 10:
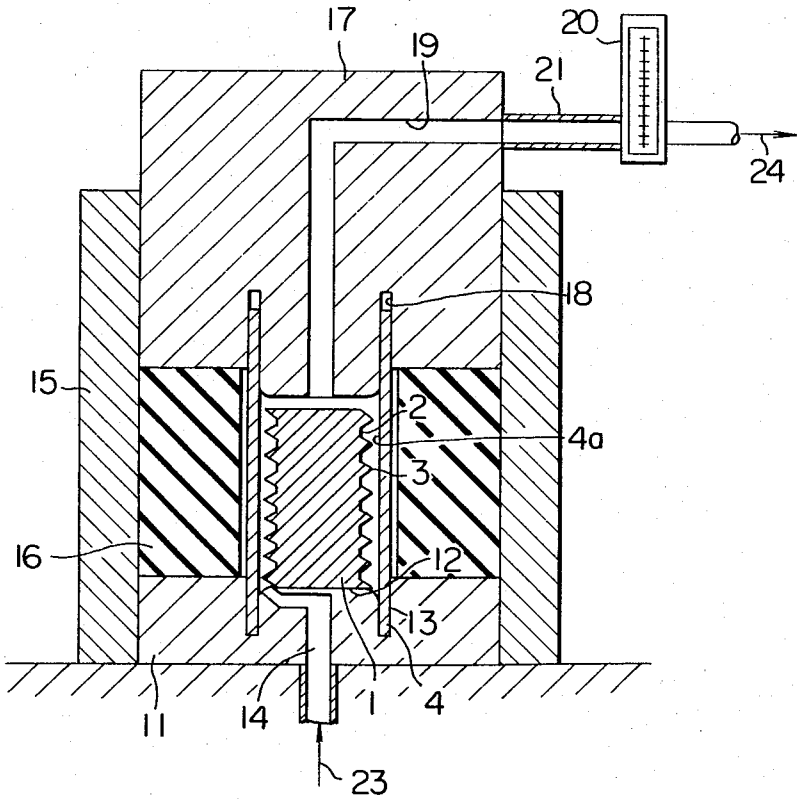
FIG. 10 is a sectional view of a pipe contracting apparatus making use of a rubber pressure, suitable for use in the production of the fluid pressure reducing device of the invention.

A practical example of a method of producing the fluid pressure reducing device of the invention is shown in FIGS. 10 and 11 and, according to these Figures, a spacer 11 is provided with a seat 12 for mounting the core 1, an annular groove 13 for receiving and locating the lower end of the pipe 4, and a gas introduction port 14 for introducing a gas for measuring the flow resistance into the spiral passage 5 which will be formed in the process explained later in connection with FIG. 11.

The spacer 11 is surrounded by a container 15. A hollow cylindrical rubber member 16 such as urethane rubber is disposed to fill the space defined between the pipe 4 and the container 15. This rubber member 16 can easily be deformed elastically by the external force to press the outer peripheral surface of the pipe 4. Thus, the rubber member 16 serves as a pressure medium which imparts the contracting load to the pipe 4. A punch 17 adapted to slide along the inner peripheral surface of the container 15, imparts the contracting pressure to the outer peripheral surface of the pipe 4 through the medium of the rubber member 16. The punch 17 is provided with an annular groove 18 for receiving and locating the upper end of the pipe 4, and a gas discharging port 19 for discharging the resistance measuring gas which will be mentioned later. A pressure gauge 20 is provided in a gas discharge pipe 21 connected to the gas discharge port 19 of the punch 17.

The apparatus shown in FIG. 10 contracts the pipe in the following manner.

First of all, the core 1, provided beforehand with a spiral groove 2, is seated on the seat 12 of the spacer 11, and the lower end of a straight copper pipe 4 is inserted into the groove 13. Then, the rubber member 16, which, in the illustrated embodiment, is a urethane rubber member, is placed between the outer peripheral surface of the pipe 4 and the inner peripheral surface of the container 15.

Then, the punch 17 is lowered so that the upper end of the pipe 4 is received by the groove 18 of the punch 17, thus completing the setting.

After the setting, the contracting force 22 is applied by a press (not shown) to cause an elastic deformation of the rubber member 16, as shown in FIG. 11. Consequently, the contracting force is applied through the rubber member 16 to the outer surface of the pipe 4.

The application of the contracting force through the medium of the rubber member 16 will be referred to as "application of rubber pressure", hereinafter.

As a result of the application of the rubber pressure, the pipe 4 is contracted radially so that the ridges 3 of the spiral groove 2 of the core 1 intrude into the inner peripheral surface 4a of the pipe 4, so that a spiral passage 5 is formed between the pipe 4 and the core 1.

In the middle course of the process, nitrogen gas is introduced into the gas introduction port 14 from the gas inlet side 23, in order to measure the flow resistance of the half-finished fluid pressure reducing device. The gas is introduced to the pressure gauge 20 through the spiral passage 5 formed between the core 1 and the pipe 4 and via the gas discharge port 19 and the gas discharge pipe 21. The flow resistance is measured by means of the pressure gauge 20 while relieving the gas from the gas outlet side 24.

The adjustment of the flow resistance is made by controlling the contracting force to finely adjust the amount of contraction of the pipe 4, while observing the change of the gas pressure through the pressure gauge 20. The contracting force is removed to complete the contraction of the pipe when the flow resistance falls within a specified range of, for example, 150±10 mmAq.

As has been described, the fluid pressure reducing device of the invention can be produced by applying the contracting force to the pipe through the medium of a rubber member 16. Consequently, the construction of the production equipment is simplified and the installation cost of the same is reduced remarkably. The time required for the processing is also shortened advantageously.

In addition, the easy control of the pipe contracting force facilitates the fine adjustment of the amount of pipe contraction, which in turn permits a production of the fluid pressure reducing device at a high precision.

Namely, according to the described method of producing the fluid pressure reducing device of the invention, a rubber pressure is applied to the outer surface of the pipe 4 receiving a core 1 which is beforehand provided with a spiral groove 2, so that the pipe is radially contracted to make the ridges 3 of the spiral groove 2 of the core 1 intrude into the inner peripheral surface 4a of the pipe 4 to thereby form a spiral passage 5 between the pipe 4 and the core 1. This method advantageously makes it possible to produce the fluid pressure reducing device of the invention with a less-expensive apparatus having a simple construction and in a short period of time.

Figure 12:
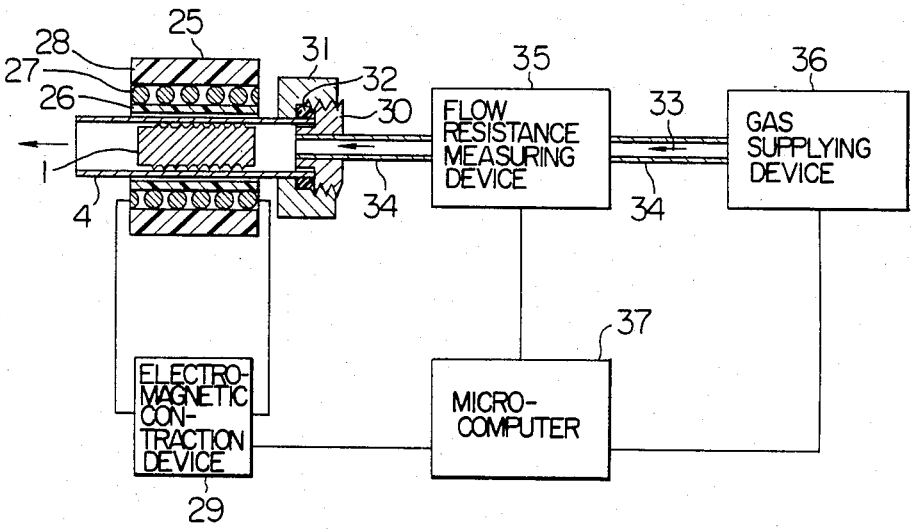
FIG. 12 is a sectional view of a pipe contracting apparatus making use of an electromagnetic pressure, suitable for use in the production of the fluid pressure reducing device of the invention.
Figure 13:
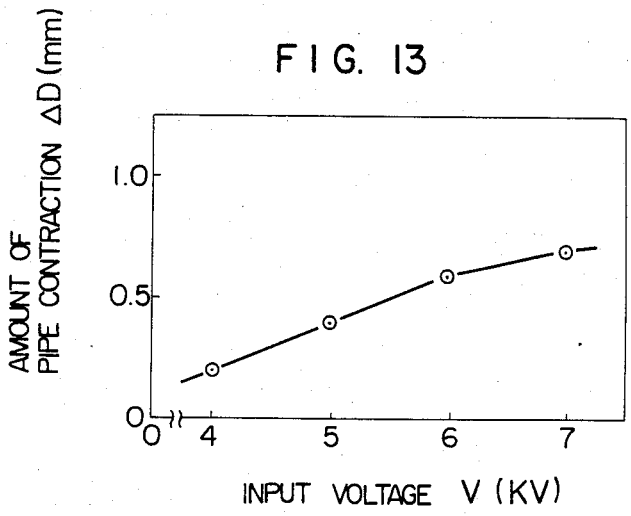
FIG. 13 is a calibration chart showing the relationship between input voltage and amount of pipe contraction as observed in the apparatus shown in FIG. 12.

FIGS. 12 and 13 provide an example of another method of producing the fluid pressure reducing device of the invention.

As shown in FIG. 12, contracting coil 25 includes a cylindrical insulating ring 26, a coil body 27 made of pure copper and wound round the insulating ring 26, and a reinforcement ring 28 disposed around the coil body 27. An electromagnetic contracting machine 29 is adapted to supply an electric current to the coil body 27 of the contracting coil 25.

A seal ring 30 is adapted to be fitted into one end of the part to be processed, i.e. the pipe 4 receiving the core 1 while a fixing ring screwed 31 is threaded to an outer surface of the seal ring, 30. An "O" ring disposed between the seal ring 30 and the fixing ring 31 is pressed as the fixing ring 31 is threadably secure to the seal ring 30, to thereby prevent a later-mentioned gas from leaking to the outside. A pipe 30 is inserted into the seal ring 30. A flow resistance measuring device 35, provided at an intermediate portion of the pipe 34, is adapted to measure the flow resistance in the fluid pressure reducing device through the change in the pressure of the gas 33. The gas 33 is supplied into the pipe 34 by means of a gas supplying device 36.

The apparatus further includes a microcomputer 37 which gives instructions to the electromagnetic contracting machine 29 concerning the initial voltage which is to be applied by the contracting machine 29 to the coil body 27. The computer 37 also makes, in the middle course of the pipe contracting operation, a comparison between the actually measured flow resistance and a previously given demand in accordance with the specification. When the demand is not met, the microcomputer 37 calculates the voltage which is to be applied by the electromagnetic contracting machine 29 to the coil body 27. If the demand is met, the microcomputer 37 delivers a work completion signal and makes the gas supplying device 36 stop the supply of the gas 33 into the pipe 34.

The practical procedure of the pipe contracting operation using this pipe contracting apparatus of FIG. 12 will be explained hereinunder.

The pipe 4 receiving the core 1 is set at the inside of the insulation ring 26 to the contracting coil 25. Then, the fixing ring 31, "O" ring 32 and the seal ring 30 are fitted to one end of the pipe 4. Then, the fixing ring 31 is tightly threaded onto the seal ring 30 to clamp the "O" ring therebetween to, thereby effect the sealing.

Then, a predetermined initial voltage and a predetermined flow resistance corresponding with the demand by the specification are stored or memorized in the microcomputer 37. The initial voltage is a voltage which can produce a pipe contraction smaller than the desired final pipe contraction. With reference to FIG. 13, the case, this initial voltage is selected to be 4 KV, while the flow resistance is determined to be, for example, 400±10 mmAq. Then, the elecromagnetic contracting machine 29 is started to supply an electric current to the coil body 27 at the above-mentioned initial voltage.

An electromagnetic force is generated by the mutual interaction between the electric current supplied to the coil body 27 and the induction electric current which is induced in the pipe 4, so that the pipe 4 is radially contracted electromagnetically in quite a short time of 20 to 40 μsec. This work will be referred to as "primary work", hereinunder. After the completion of the primary work, a gas 33 such as nitrogen, air or the like is supplied by the gas supplying device 36 into the pipe 34, and the flow resistance in the worked pipe is measured by the flow resistance measuring device 35. The result of the measurement is delivered to the microcomputer 37 for comparison with the aforementioned demand by the specification. If the demand is met, the microcomputer 37 delivers an order to stop the contracting operation and to stop the supply of the gas 33 from the gas supplying device 36, thus completing the contraction of the pipe of the fluid pressure reducing device.

In contrast, when the demand is not met, the microcomputer 37 calculates the voltage for the next work, i.e. the secondary work. This voltage is delivered to the electromagnetic contracting machine 29 so that the secondary work is effected in the same manner as the primary work. The measurement of the flow resistance is made also in the same manner as the first work and a judgement is made by the microcomputer 37 as to whether the demand by the specification is met. The contracting work is thus repeated until the flow resistance demanded by the specification is met. In this example, the flow resistance meeting the demand was obtained after three times of contracting work. The total time required for the completion of the work was about 20 seconds.

Thus, according to this method, the pipe contracting work is made electromagnetically and the contraction amount is controlled by an on-line controlled using a microcomputer 37 while measuring the flow resistance. It is, therefore, possible to produce the fluid pressure reducing device without any substantial fluctuation of the quality or performance. In addition, since the examination step can be omitted, the cost of production of the fluid pressure reducing device is reduced economically.

As has been described, the present invention provides also a method of producing a fluid pressure reducing device in which the pipe 4 receiving the core 1 provided beforehand with a spiral groove 2 is radially contracted electromagnetically, so that the ridges 3 of the spiral groove 2 of the core 1 intrude into the inner peripheral surface 4a of the pipe 4 thereby to form a spiral passage 5 between the pipe 4 and the core 1 so as to provide a communication between both ends of the pipe 4. According to this method, it is possible to shorten the time length required for the work and to easily and finely adjust the flow resistance in the fluid pressure reducing device.

What is claimed is:

1. A method of producing a fluid pressure reducing device, the method comprising the steps of:

inserting a solid core provided with a peripheral spiral groove extending from one end thereof to the other into a relatively thin metal pipe having an inner diameter larger than an outer diameter of said core and made of a material softer than material of said core; and applying a radially compressive force to the portion of said pipe receiving said core to thereby contract said portion of said pipe into said spiral groove so that the inner diamneter thereof is smaller than the outer diameter of said core but larger than a diameter of a root of said spiral groove to allow a predetermined amount of fluid to flow through said groove.

2. A method of producing a fluid pressure reducing device as claimed in claim 1, further comprising the steps of:

flowing a fluid through a spiral passage formed between an inner peripheral surface of said pipe and spiral groove and measuring a flow resistance; and effecting contraction of said pipe while controlling the compressive forces in such a manner so as to make the measured flow resistance coincide with a predetermined value.

3. A method of producing a fluid pressure reducing device as claimed in claim 2, wherein said radially compressive force is applied to said pipe through an elastic means.

4. A method of producing a fluid pressure reducing device as claimed in claim 2, wherein said radially compressive force is applied by electromagnetic means.

5. A method of producing a fluid pressure reducing device as claimed in claim 1, wherein said compressive force is applied to said pipe through a high molecular compound of a high elasticity.

6. A method of producing a fluid pressure reducing device as claimed in claim 1, wherein said compressive force is applied to said pipe through an incompressible fluid.

7. A method of producing a fluid pressure reducing device as claimed in claim 1, wherein said compressive force is an electromagnetic force which is generated by an induced electric current flowing in said pipe and core.

8. A method of producing fluid pressure reducing device, the method comprising the steps of:

inserting a solid core provided with a peripheral spiral groove extending from one end thereof to the other into a relatively thin metal pipe, said pipe having an inner diameter larger than an outer diameter of said core and made of a material softer than the material of said core;

applying a radially compressive force to a portion of said pipe receiving said core to thereby contract said portion into said spiral groove so that an inner diameter of said portion is smaller than an outer diameter of said core but larger than a diameter of a root of said spiral groove;

flowing a fluid through a spiral passage formed by an inner peripheral surface of said pipe and said spiral groove of the core;

measuring the flow resistance; and removing said compressive force when the measured flow resistance coincides when a predetermined value.

9. A method of producing a fluid pressure reducing device as claimed in claim 8, further comprising the step of flowing a fluid through said spiral passage and measuring the flow resistance after a removal of said compressive force.

10. A method of producing a fluid pressure reducing device as claimed in claim 9, wherein said compressive force is applied to said pipe through a high molecular compound of high elasticity.

11. A method of producing a fluid pressure reducing device as claimed in claim 9, wherein said compressive force is applied to said pipe through an incompressible fluid.

12. A method of producing a fluid pressure reducing device as claimed in claim 9, wherein said compressive force is an electromagnetic force which is generated by an induced electric current flowing in said pipe and said core.

13. A method of producing a fluid pressure reducing device as claimed in claim 8, wherein said compressive force is applied to said pipe through a high molecular compound of high elasticity.

14. A method of producing a fluid pressure reducing device as claimed in claim 8, wherein the compressive force is applied to said pipe through an incompressible fluid.

15. A method of producing a fluid pressure reducing device as claimed in claim 8, wherein said compressive force is an electromagnetic force generated by an induced electric current flowing in said pipe and said core.

* * * * *